US009909320B2

(12) United States Patent
Vowles

(10) Patent No.: US 9,909,320 B2
(45) Date of Patent: Mar. 6, 2018

(54) ROOF FLASHING

(71) Applicant: Dennis Vowles, Toledo, OH (US)

(72) Inventor: Dennis Vowles, Toledo, OH (US)

( * ) Notice: Subject to any disclaimer, the term of this patent is extended or adjusted under 35 U.S.C. 154(b) by 0 days.

(21) Appl. No.: 15/367,977

(22) Filed: Dec. 2, 2016

(65) Prior Publication Data

US 2017/0159296 A1 Jun. 8, 2017

Related U.S. Application Data

(60) Provisional application No. 62/262,469, filed on Dec. 3, 2015.

(51) Int. Cl.

| | |
|---|---|
| ***E04D 13/147*** | (2006.01) |
| *E04D 13/04* | (2006.01) |
| *E04D 13/17* | (2006.01) |
| *E04D 13/03* | (2006.01) |
| *E04D 1/30* | (2006.01) |
| *F24F 7/02* | (2006.01) |

(52) U.S. Cl.

CPC ..... *E04D 13/1476* (2013.01); *E04D 13/033* (2013.01); *E04D 13/0409* (2013.01); *E04D 13/17* (2013.01); *E04D 2001/307* (2013.01); *E04D 2013/0436* (2013.01); *F24F 7/02* (2013.01)

(58) Field of Classification Search

CPC ..... F24F 7/02; E04D 13/143; E04D 13/147; E04D 13/1476; E04D 13/17; E04D 13/0409; E04D 2013/0436; E04D 13/033; E04D 2001/307

See application file for complete search history.

(56) References Cited

U.S. PATENT DOCUMENTS

| | | | | |
|---|---|---|---|---|
| 791,068 | A * | 5/1905 | Baker | E04D 13/1476 285/43 |
| 917,167 | A | 4/1909 | Shaw | |
| 1,258,884 | A | 3/1918 | Fife | |
| 2,800,850 | A | 7/1957 | McKann | |
| 3,313,559 | A | 4/1967 | Kifer | |
| 3,677,576 | A | 7/1972 | Gustafson | |
| 3,731,952 | A | 5/1973 | Elwart | |
| 3,807,110 | A | 4/1974 | Kaminski | |
| 3,945,163 | A | 3/1976 | Nagler et al. | |
| 4,010,578 | A | 3/1977 | Logsdon | |
| 4,120,129 | A | 10/1978 | Nagler et al. | |
| 4,211,423 | A | 7/1980 | Resech | |
| 4,265,058 | A | 5/1981 | Logsdon | |
| 4,333,660 | A | 6/1982 | Cupit | |
| 4,563,847 | A | 1/1986 | Hasty | |
| 4,570,396 | A | 2/1986 | Struben | |
| 4,635,409 | A * | 1/1987 | Vandemore | E04D 13/1407 138/159 |
| 4,664,390 | A | 5/1987 | Houseman | |
| 4,864,782 | A | 9/1989 | Hasty | |

(Continued)

*Primary Examiner* — Babajide A Demuren

(57) ABSTRACT

A roof flashing can include a bottom half and a top half. The two halves can each have a plate and a neck portion projecting away from the respective plate. The neck portions define portions of an aperture configured to encircle and seal against a post projecting away from a roof. At least part of the first neck portion can be slidably receivable in the second neck portion and the two portions can define a neck when the bottom half and the top half are engaged with one another.

15 Claims, 10 Drawing Sheets

(56) References Cited

U.S. PATENT DOCUMENTS

| | | | | |
|---|---|---|---|---|
| 4,903,997 | A | 2/1990 | Kifer | |
| 4,937,991 | A | 7/1990 | Orth | |
| 5,036,636 | A | 8/1991 | Hasty | |
| 5,176,408 | A | 1/1993 | Pedersen | |
| 5,226,263 | A | 7/1993 | Merrin et al. | |
| 5,472,241 | A | 12/1995 | Kosik et al. | |
| 5,588,267 | A | 12/1996 | Rodriguez et al. | |
| 5,860,256 | A * | 1/1999 | Humber | E04D 13/1476 285/42 |
| 5,899,034 | A | 5/1999 | Vermilion et al. | |
| 5,946,863 | A | 9/1999 | Bullard | |
| 5,970,667 | A | 10/1999 | Thaler | |
| 6,327,820 | B1 | 12/2001 | Picco | |
| 6,601,351 | B1 | 8/2003 | Zerfoss | |
| 6,601,352 | B1 | 8/2003 | Obermeyer et al. | |
| 6,691,469 | B2 | 2/2004 | Miller | |
| 8,141,303 | B2 | 3/2012 | McDow et al. | |
| 8,291,658 | B1 | 10/2012 | Johnston et al. | |
| 8,534,002 | B2 | 9/2013 | McDow et al. | |
| 9,169,648 | B1 * | 10/2015 | Mills | E04D 13/1476 |
| 2002/0108316 | A1 | 8/2002 | Miller | |

* cited by examiner

ROOF FLASHING

CROSS-REFERENCE TO RELATED APPLICATIONS

This application claims the benefit of U.S. Provisional Patent Application Ser. No. 62/262,469 for a 2 PIECE CONDUIT OR PIPE FLASHING FOR RESHINGLING, filed on 2015 Dec. 3, which is hereby incorporated by reference in its entirety.

BACKGROUND

1. Field

The present disclosure relates to roof flashing.

2. Description of Related Prior Art

U.S. Pat. No. 6,691,469 discloses FLASHING FOR ROOF PENETRATIONS. A flashing for sealing about a roof penetration includes a first sheet having a first edge. The first sheet includes a substantially planar portion and a portion that is inclined with respect to the planar portion. The inclined portion has a recess open at the first edge. A second sheet has a first edge. The second sheet includes a substantially planar portion and a portion that is inclined with respect to the planar portion. The inclined portion has a recess open at the first edge.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A roof flashing can include a bottom half and a top half. The bottom half can have a first plate extending in a first plane and a first neck portion projecting away from the first plate and the first plane. The first neck portion can be arcuate and can be centered on a first axis that intersects the first plane at an acute angle. The first neck portion defines a first portion of an aperture configured to encircle and seal against a post projecting away from a roof. The top half can have a second plate and a second neck portion projecting away from the second plate. The second neck portion can be arcuate and can be centered on a second axis that intersects the second plate at an acute angle. The second neck portion can define a second portion of the aperture. At least part of the first neck portion can be slidably receivable in the second neck portion. The first neck portion and the second neck portion can define a neck of the roof flashing when the bottom half and the top half are engaged with one another.

BRIEF DESCRIPTION OF THE DRAWINGS

The detailed description set forth below references the following drawings.

DETAILED DESCRIPTION

Figure 1:
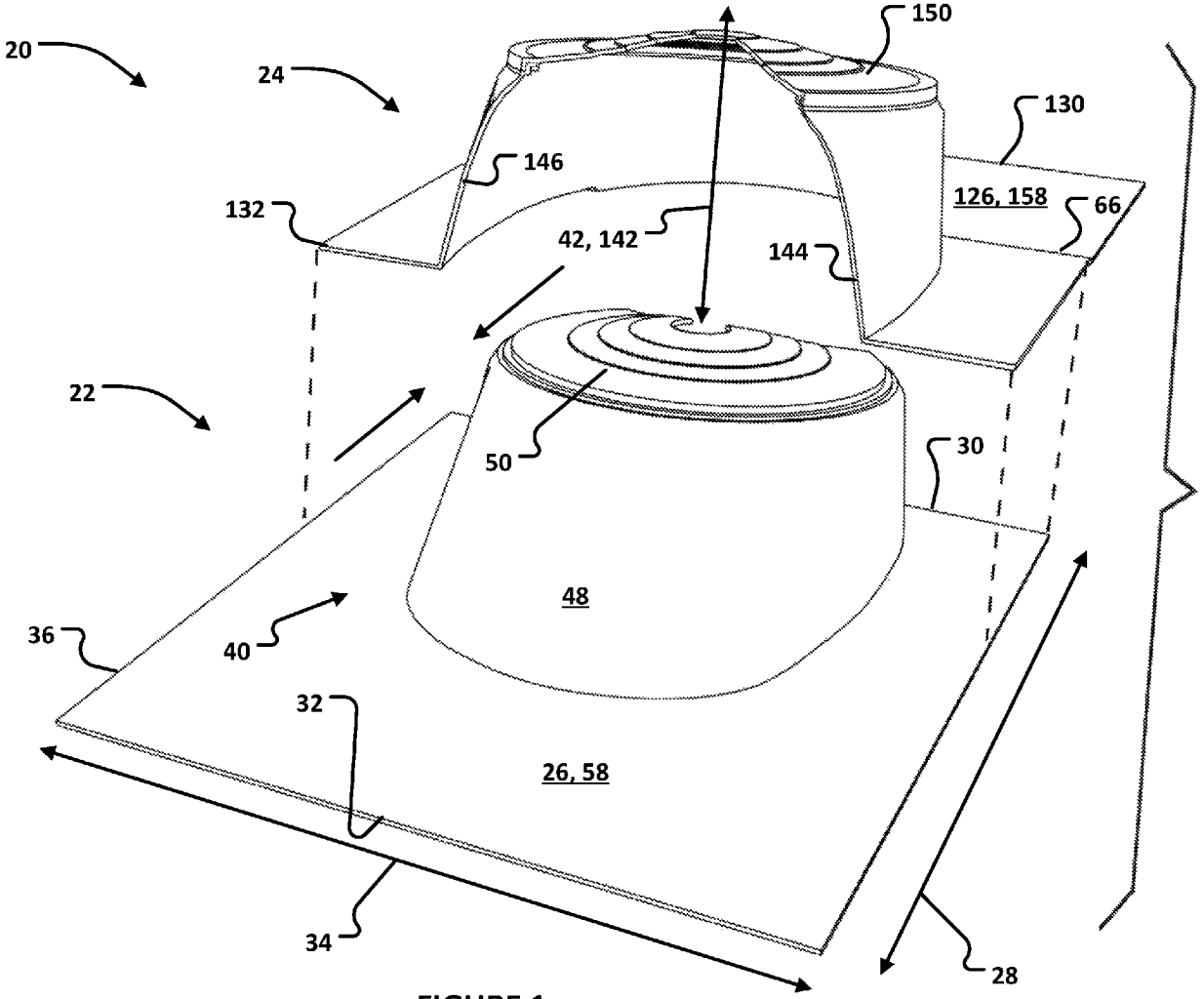
FIG. 1 is an exploded view of an exemplary embodiment of the present disclosure.
Figure 3:
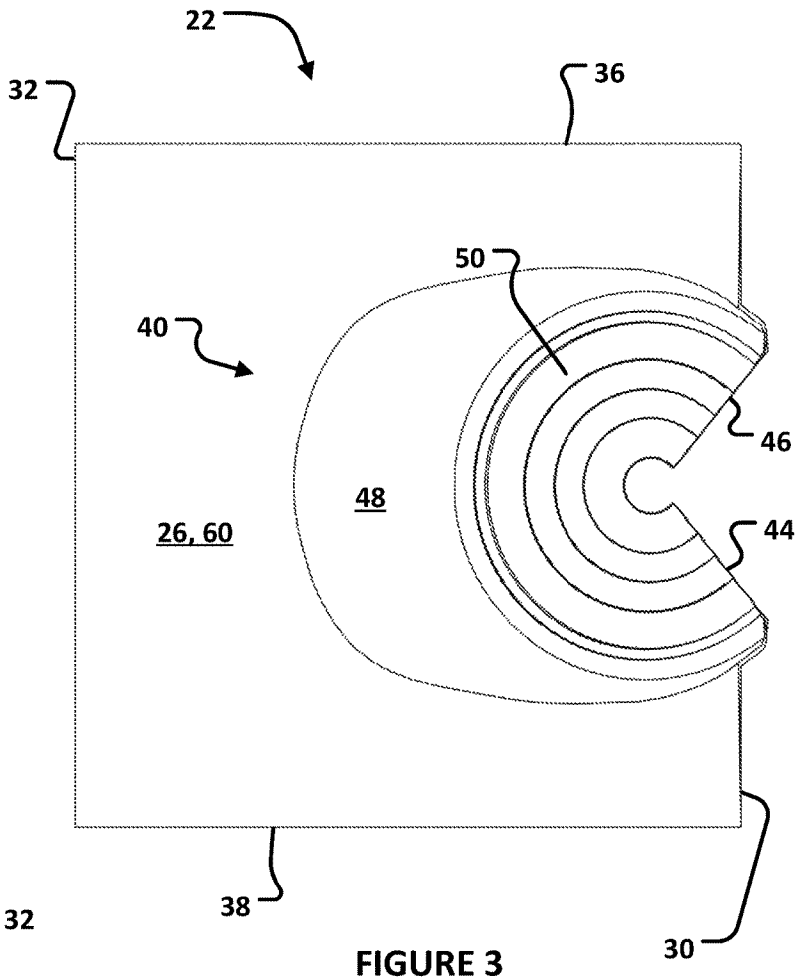
FIG. 3 is a bottom view of the bottom half of the exemplary embodiment of the present disclosure.
Figure 2:
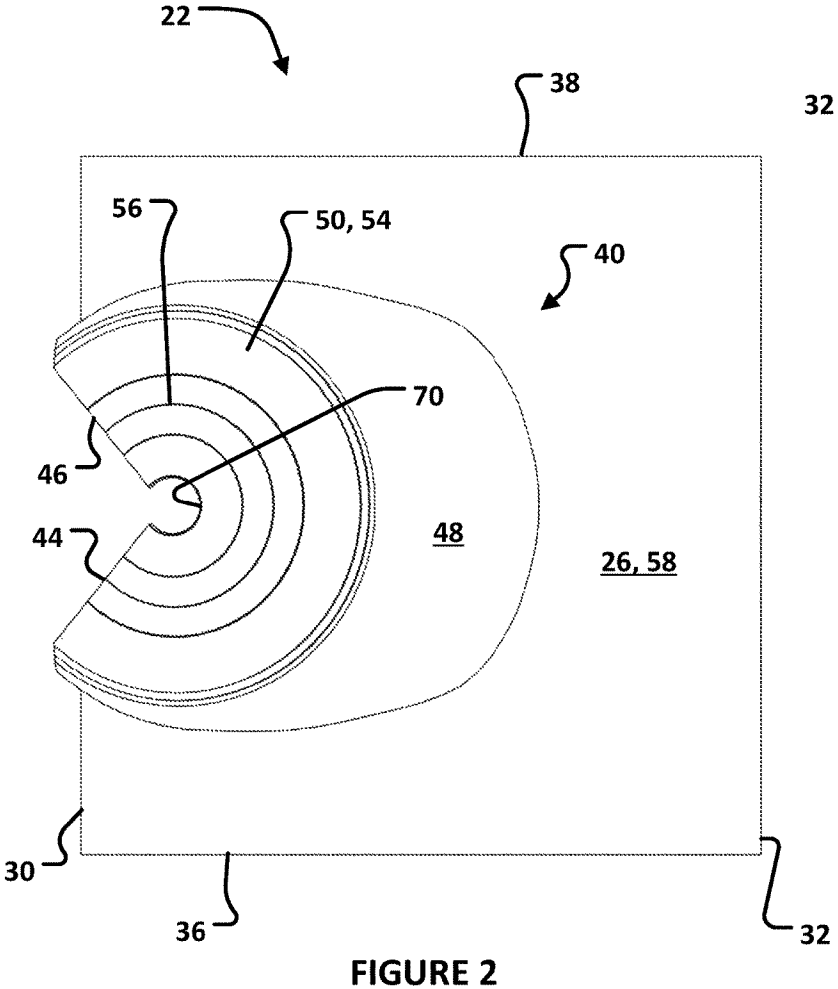
FIG. 2 is a top view of a bottom half of the exemplary embodiment of the present disclosure.
Figure 4:
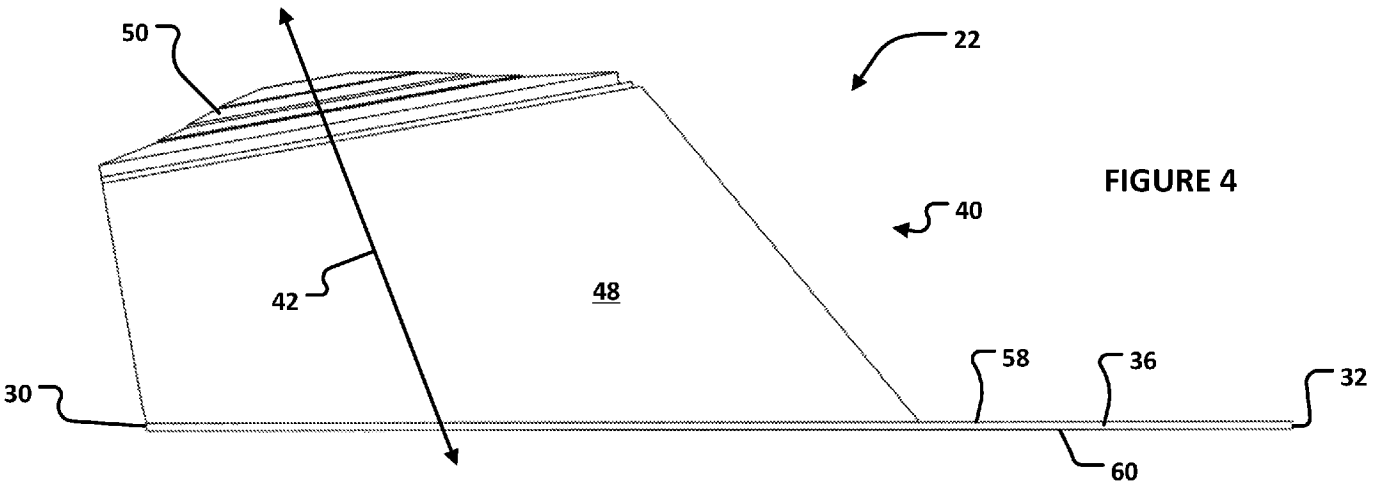
FIG. 4 is a front view of the bottom half of the exemplary embodiment of the present disclosure.
Figure 5:
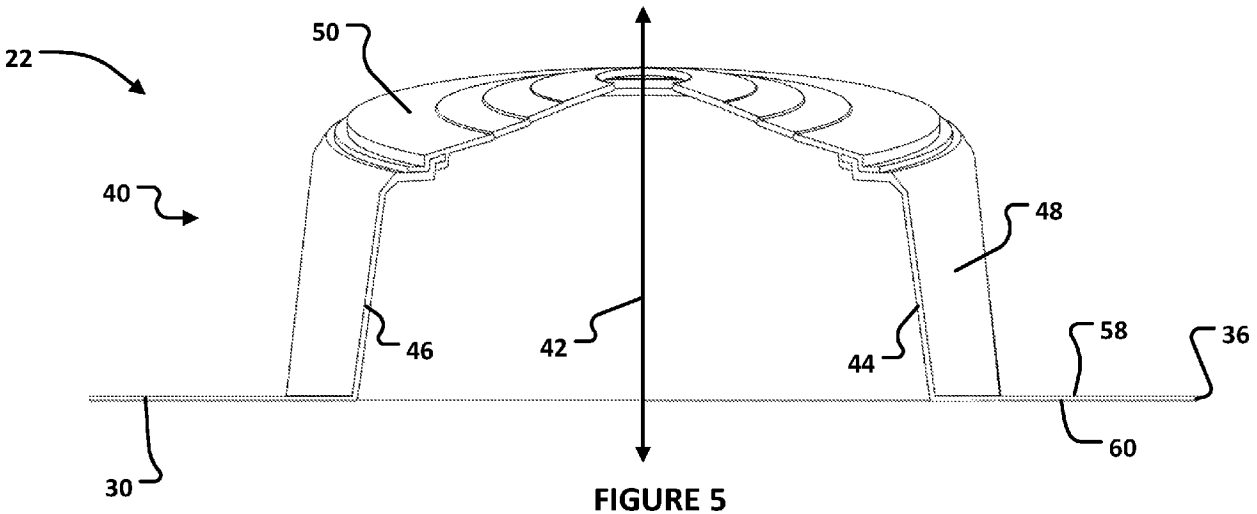
FIG. 5 is a left-side view of the bottom half of the exemplary embodiment of the present disclosure.
Figure 7:
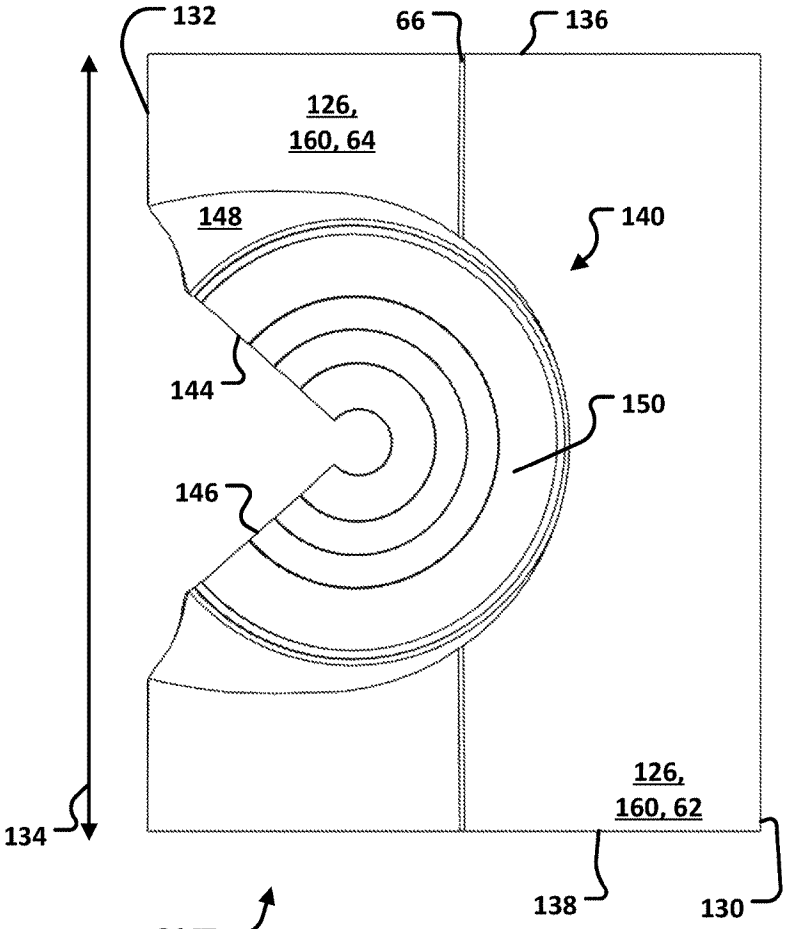
FIG. 7 is a bottom view of the top half of the exemplary embodiment of the present disclosure.
Figure 6:
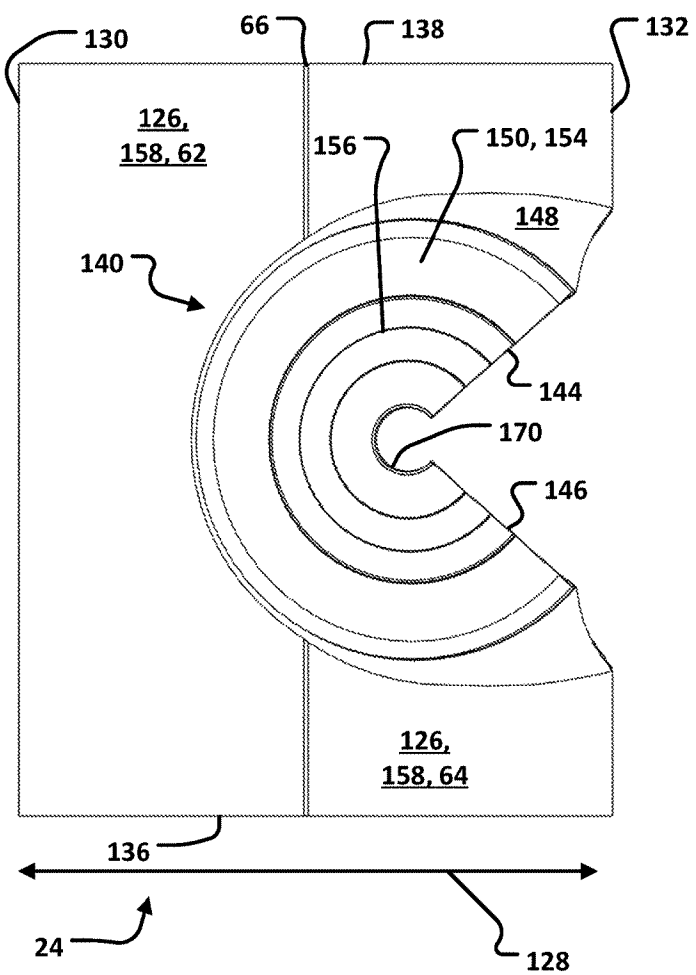
FIG. 6 is a top view of a top half of the exemplary embodiment of the present disclosure.
Figure 8:
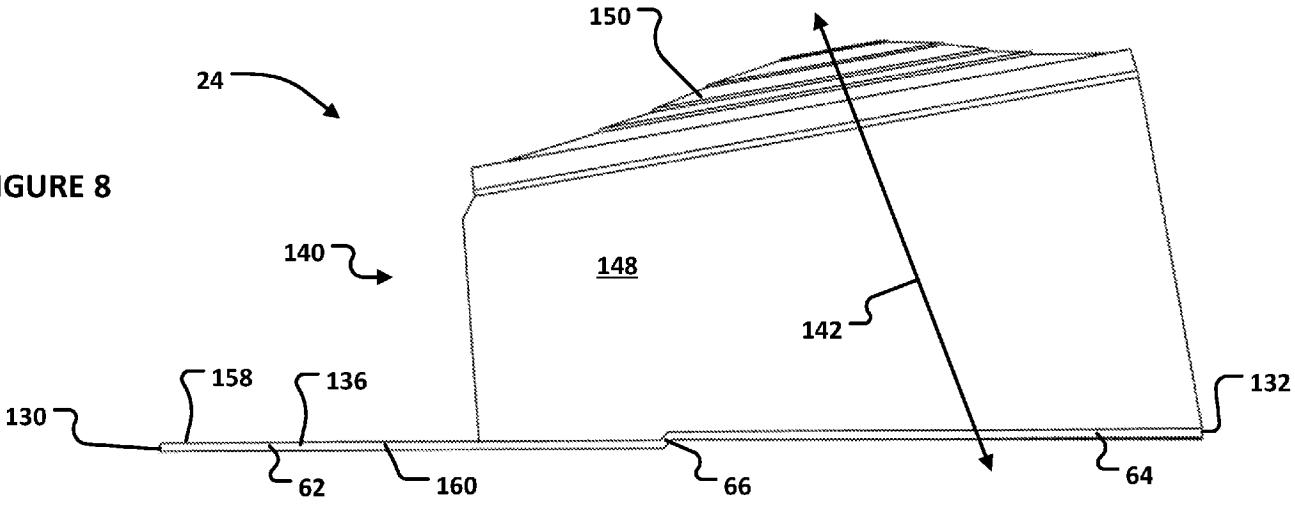
FIG. 8 is a front view of the top half of the exemplary embodiment of the present disclosure.
Figure 9:
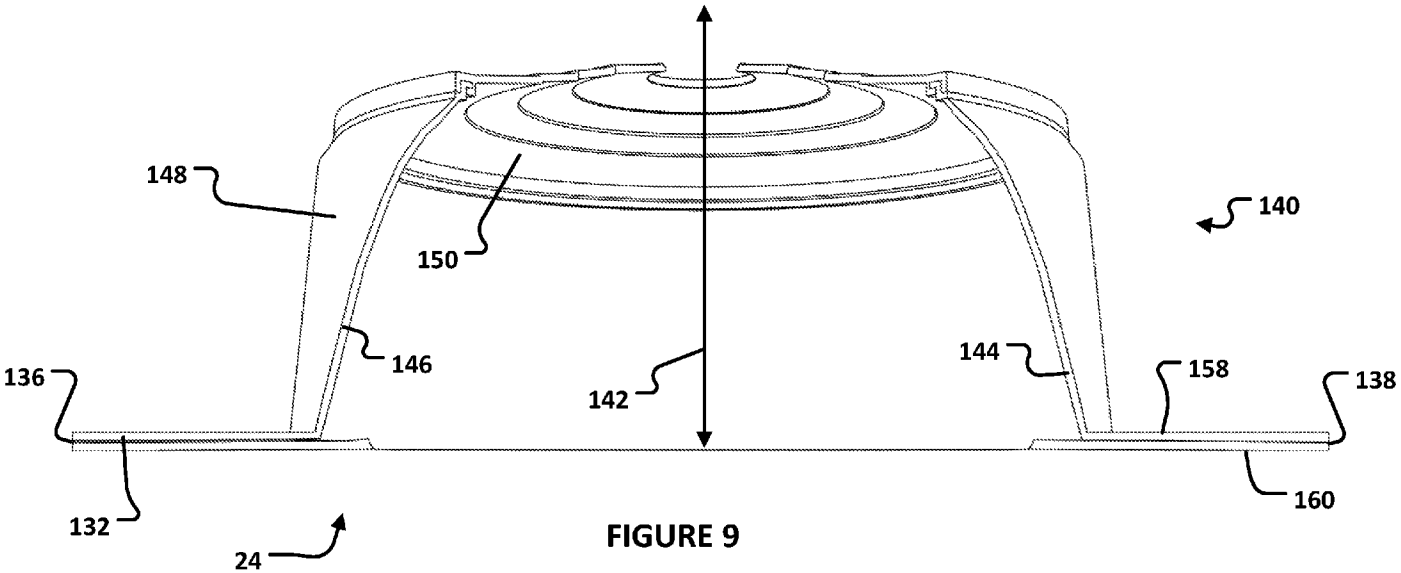
FIG. 9 is a right-side view of the top half of the exemplary embodiment of the present disclosure.
Figure 10:
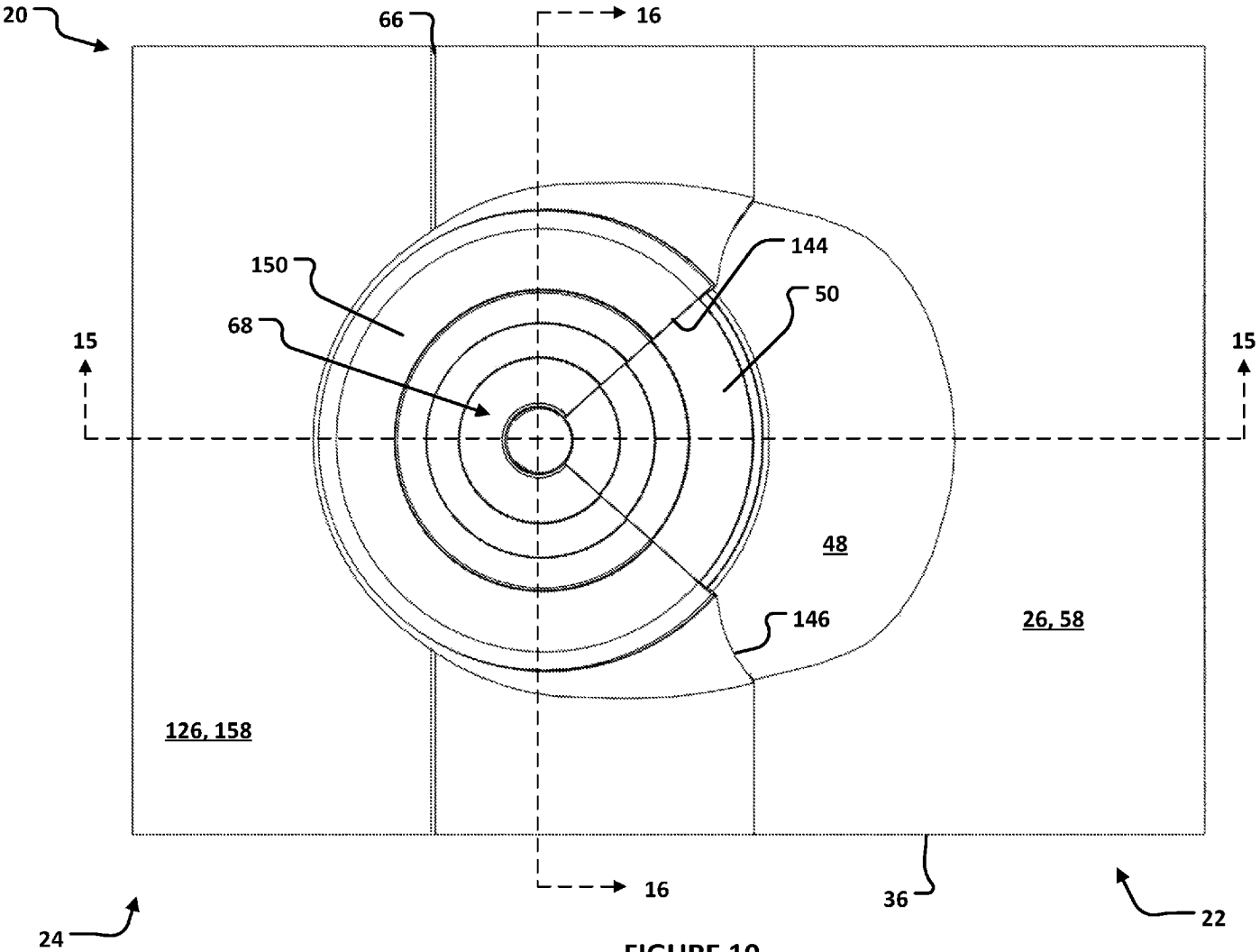
FIG. 10 is a top view of the exemplary embodiment of the present disclosure.

An assembled and exemplary roof flashing according to the present disclosure is referenced at 20 in the drawing figures. The exemplary roof flashing 20 includes a bottom half 22 and a top half 24. The bottom half 22 is shown without the top half 24 in FIGS. 2-5. The top half 24 is shown without the bottom half 22 in FIGS. 6-9.

The exemplary bottom half 22 has a first plate 26 extending general in a first plane. The exemplary bottom half 22 has a thickness so it does not extend only in single plane, but is generally planar. The first plane can lie flush with the surface of a roof on which the roof flashing 20 is mounted. The first plate 26 can extend a length (referenced at 28) between an upper edge 30 and lower edge 32. The first plate 26 can also extend a width (referenced at 34) between a first lateral edge 36 and a second lateral edge 38. The first plate 26 can also have a thickness defined between a top surface 58 and a bottom surface 60.

The exemplary bottom half 22 also has a first neck portion 40 projecting away from the first plate 26 and the first plane. The exemplary first neck portion 40 has a shape that is frusto- as well as bi-conical. The exemplary first neck portion 40 is generally half of a cone without a pointed top. The exemplary first neck portion 40 is arcuate about and centered on a first axis 42 that intersects the first plane at an acute angle. The exemplary first neck portion 40 can extend about the first axis 42 between a first edge 44 and a second edge 46.

Figure 18:
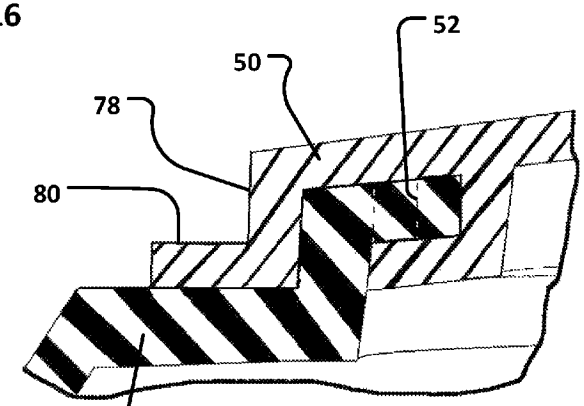
FIG. 18 is a detail view of the bottom half of the exemplary embodiment of the present disclosure.

The exemplary first neck portion 40 further comprises a pipe portion 48 formed from a first material. The exemplary first neck portion 40 further comprises a sealing portion 50 formed from a second material. Both of the exemplary pipe portion 48 and the sealing portion 50 extend between first and second edges 44, 46. The first material is more rigid than the second material. The first material can be a relatively rigid plastic such as polypropylene and the second material can be a relatively flexible material such a rubber or urethane. The sealing portion 50 cane formed in situ on the pipe portion 48. The exemplary pipe portion 48 includes a plurality of apertures and the exemplary sealing portion 50 is formed in situ on the pipe portion 48. During application of the sealing form (in liquid form), the second material can flow through the apertures so that the cured sealing portion 50 extends through the plurality of apertures. An exemplary aperture is referenced in hidden line in FIG. 18 at 52. The exemplary sealing portion 50 is also formed to define a plurality of arcuate, c-shaped portions, such as referenced at 54, interconnected by webs, such as referenced at 56. A user can removed any of the c-shaped portions to accommodate differently-sized posts by cutting the sealing portion 50 along the appropriate web.

The exemplary top half 24 has a second plate 126. The second plate 126 can extend a length (referenced at 128) between an upper edge 130 and lower edge 132. The second plate 126 can also extend a width (referenced at 134) between a first lateral edge 136 and a second lateral edge 138. The second plate 126 can also have a thickness defined between a top surface 158 and a bottom surface 160. The first and second plates 26, 126 can be nailed into a roof when installed.

The exemplary second plate 126 is configured differently than the exemplary first plate 26. The exemplary second plate 126 includes a first plate portion 62 extending in a second plane. In the exemplary embodiment, the first and second planes are coplanar when the bottom half 22 and the top half 24 are engaged with one another. In other embodiments, the first plate portion 62 and the first plate 26 may not be in the same plane. The exemplary second plate 126 also includes a second plate portion 64 extending in a third plane. The second plane and the third plane are parallel to one another.

The exemplary second plate 126 also includes a riser portion 66 extending between the first plate portion 62 and the second plate portion 64. The first plate 26 abuts the riser portion 66 and is partially overlapped by the second plate portion 64 when the bottom half 22 and the top half 24 are engaged with one another. The exemplary riser portion 66 extends non-perpendicularly relative to the second plane and the third plane.

Figure 15:
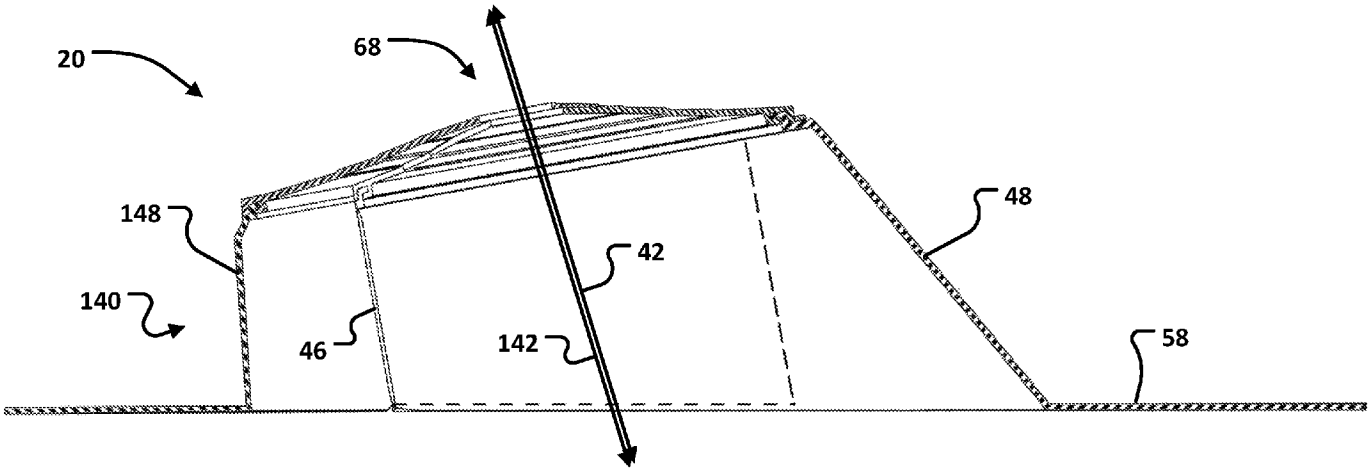
FIG. 15 is a cross-section of the exemplary embodiment of the present disclosure taken through section lines 15-15 in FIG. 10.

The exemplary top half 24 also has a second neck portion 140 projecting away from the second plate 126 and the first plane. The exemplary second neck portion 140 has a shape that is frusto- as well as bi-conical. The exemplary second neck portion 140 is generally half of a cone without a pointed top. The exemplary second neck portion 140 is arcuate about and centered on a second axis 142 that intersects the first plane at an acute angle. The exemplary second neck portion 140 can extend about the second axis 142 between a first edge 144 and a second edge 146. FIGS. 1, 12, 13, and 16 show the axes 42, 142 aligned. FIG. 15 shows the axes offset from one another. Embodiments of the present disclosure can be practiced with the axes 42, 142 aligned and with the axes 42, 142 offset from one another.

Figure 17:
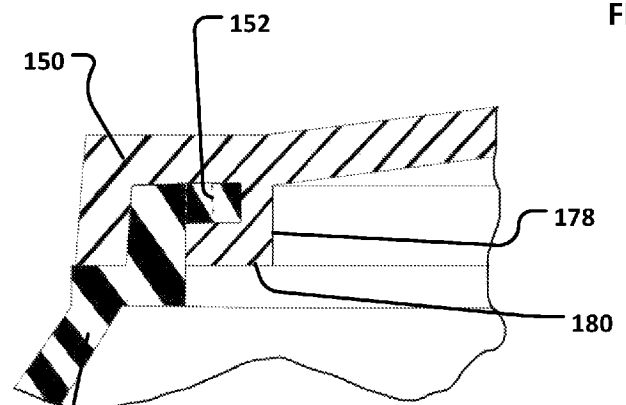
FIG. 17 is a detail view of the top half of the exemplary embodiment of the present disclosure.

The exemplary second neck portion 140 further comprises a pipe portion 148 formed from a first material. The exemplary second neck portion 140 further comprises a sealing portion 150 formed from a second material. Both of the exemplary pipe portion 148 and the sealing portion 150 extend between first and second edges 144, 146. The first material is more rigid than the second material. The first material can be a relatively rigid plastic such as polypropylene and the second material can be a relatively flexible material such a rubber or urethane. The sealing portion 150 cane formed in situ on the pipe portion 148. The exemplary pipe portion 148 includes a plurality of apertures and the exemplary sealing portion 150 is formed in situ on the pipe portion 148. During application of the sealing form (in liquid form), the second material can flow through the apertures so that the cured sealing portion 150 extends through the plurality of apertures. An exemplary aperture is referenced in hidden line in FIG. 17 at 152. The exemplary sealing portion 150 is also formed to define a plurality of arcuate, c-shaped portions, such as referenced at 154, interconnected by webs, such as referenced at 156. A user can removed any of the c-shaped portions to accommodate differently-sized posts by cutting the sealing portion 150 along the appropriate web.

Referring now to FIG. 1, the roof flashing 20 can be assembled to a post protruding from a roof by first placing the bottom half 22 on the roof and sliding the bottom half 22 against the post until an aperture defined by the sealing portion 50 abuts the post. The aperture will be detailed below. Next, the top half 24 can be placed on the roof and slid across the roof until an aperture defined by the sealing portion 150 abuts the post. The halves 22, 24 can be moved toward one another until the upper edge 30 abuts the riser portion 66.

Figure 16:
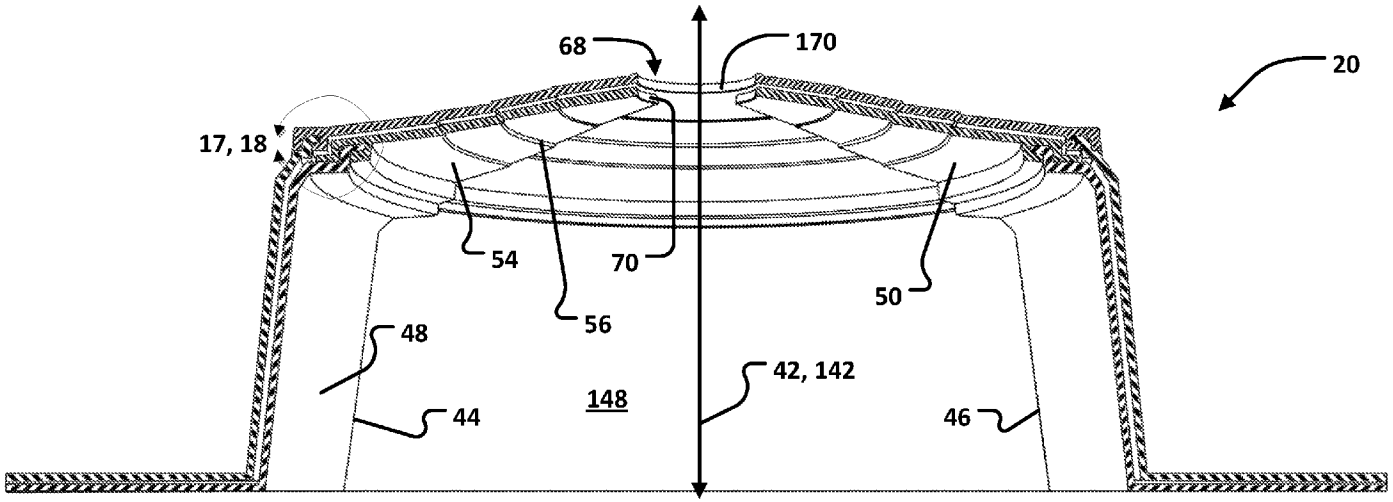
FIG. 16 is a cross-section of the exemplary embodiment of the present disclosure taken through section lines 16-16 in FIG. 10.

The bottom half 22 and the top half 24 cooperate to form the aperture surrounding the post when the bottom half 22 and the top half 24 are engaged with one another. The aperture is referenced at 68. The exemplary aperture 68 can be discontinuous as shown in FIGS. 15 and 16. The first neck portion 40 can define a first portion 70 of an aperture 68. The upper edge 30 can be positioned closer to the first portion 70 of the aperture 68 than the lower edge 32. The second neck portion 140 can defining a second portion 72 of the aperture 68. The lower edge 132 can be positioned closer to the second portion 170 of the aperture 68 than the upper edge 130. The first portion 70 is defined by the sealing portion 50 and the second portion 170 is defined by the sealing portion 150. The exemplary first portion 70 is below the exemplary second portion 170. The exemplary first portion 70 overlaps the exemplary second portion 170 along portions of the circumference of the aperture 68 about the axes 42, 142.

During assembly of the halves 22, 24, at least part of the first neck portion 40 is slidably received in the second neck portion 140. When the bottom half 22 and the top half 24 are engaged with one another, at least part of a circumferential perimeter of the first neck portion 40 about the first axis 42 is received in and overlapped by the second neck portion 140. The first neck portion 40 and the second neck portion 140 define a neck of the roof flashing 20 when the bottom half 22 and the top half 24 are engaged with one another. Adhesive or sealant can be applied between the halves 22, 24 if desired.

Figure 11:
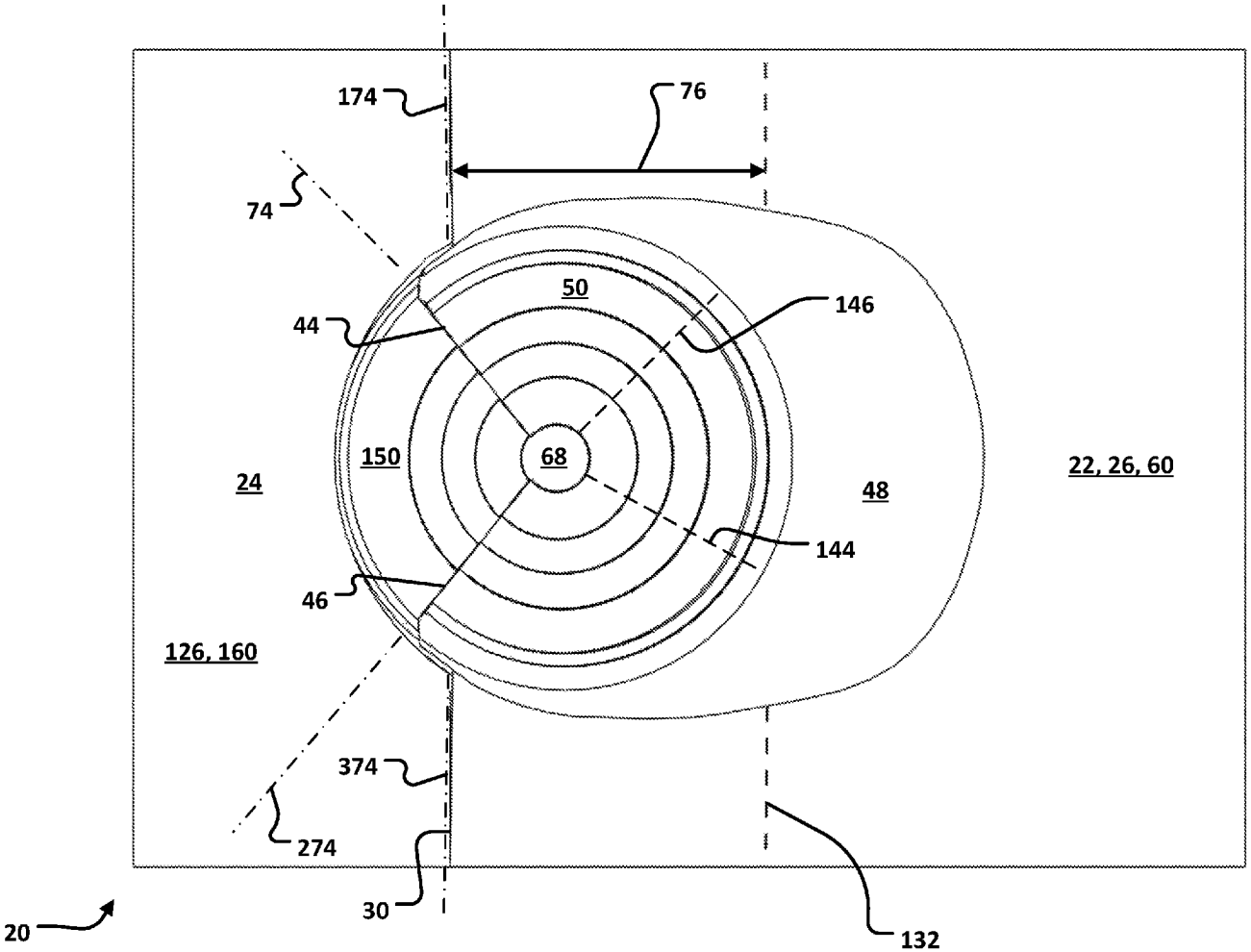
FIG. 11 is a bottom view of the exemplary embodiment of the present disclosure.
Figure 12:
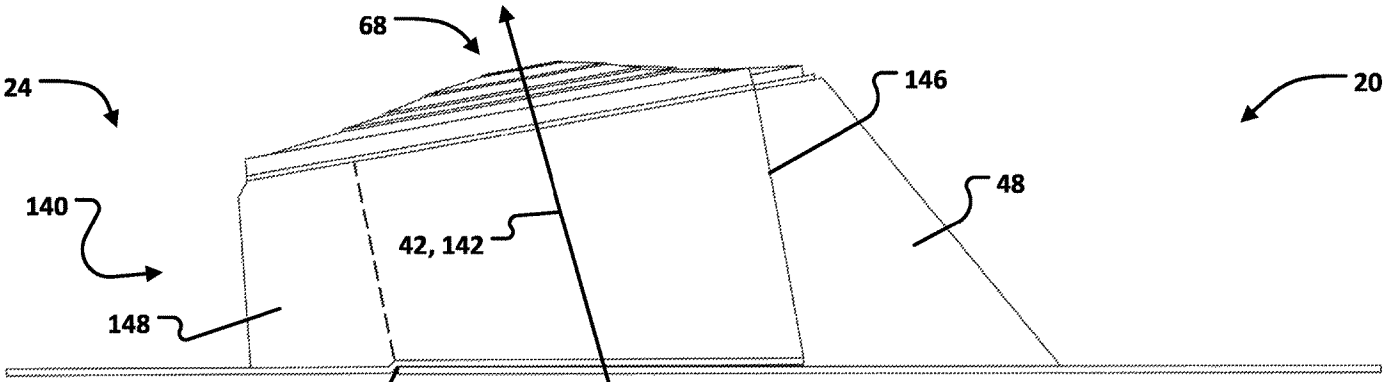
FIG. 12 is a front view of the exemplary embodiment of the present disclosure.
Figure 13:
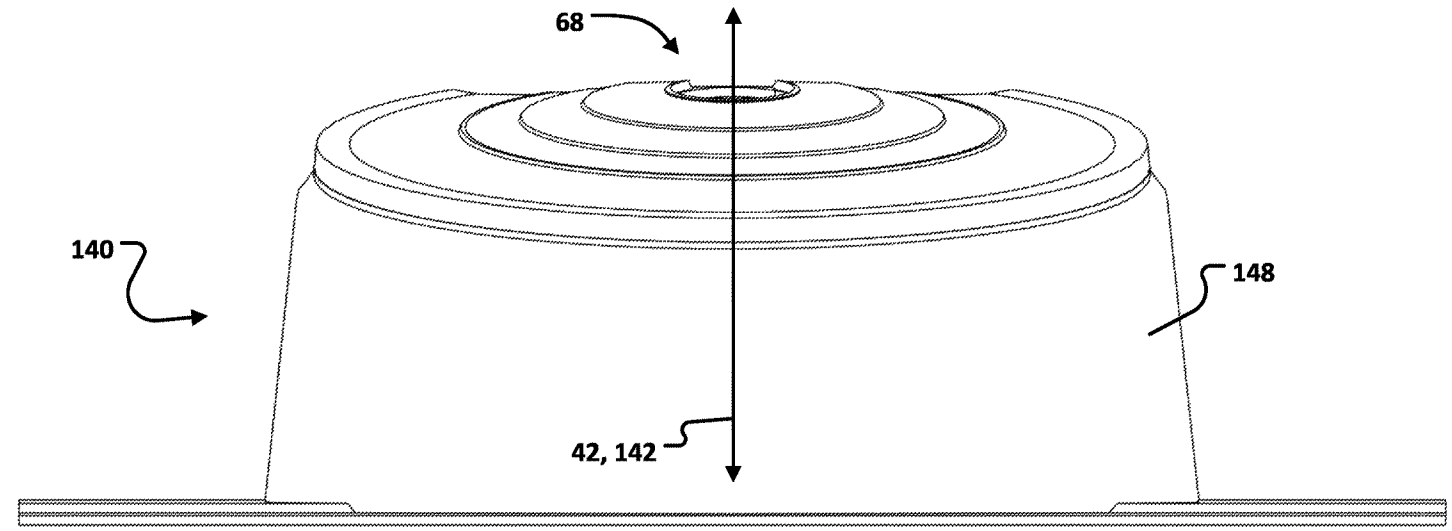
FIG. 13 is a right-side view of the exemplary embodiment of the present disclosure.
Figure 14:
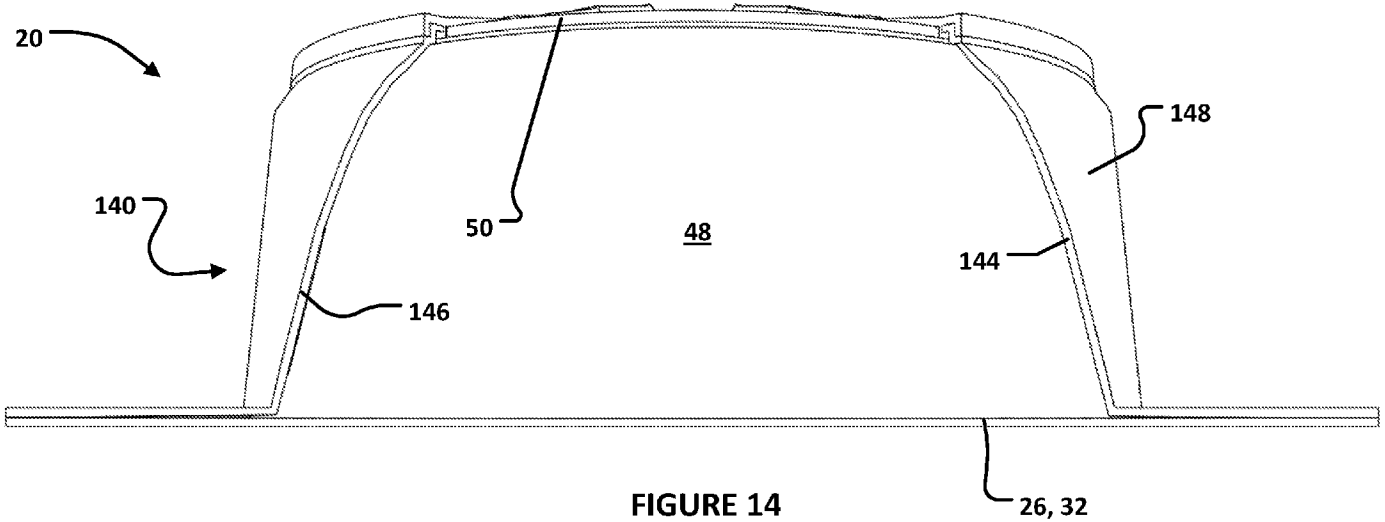
FIG. 14 is a left-side view of the exemplary embodiment of the present disclosure.

In the exemplary embodiment, part of the perimeter of the first neck portion 40 is defined beyond the upper edge 30 and is not positioned along the length 28. This is best shown in FIG. 11 wherein the portion of the first neck portion 40 that is to the left of the upper edge 30 and extends about the aperture 68 between the reference lines 74 and 174 is overlapped by the second neck portion 140 when the bottom half 22 and the top half 24 are engaged with one another and is not defined along the length. Similarly, the portion of the first neck portion 40 that is to the left of the upper edge 30 and extends about the aperture 68 between the reference lines 274 and 374 is overlapped by the second neck portion 140 when the bottom half 22 and the top half 24 are engaged with one another and is not defined along the length. These portions of the perimeter of the first neck portion 40 are a pair of mirrored, parts along its perimeter. In the exemplary embodiment, while the first neck portion 40 extends past the first plate 26, the exemplary second neck portion 140 does not extend past lower edge 32 of the second plate 126. The exemplary second neck portion thus extends only along the length 128 of the second plate 126.

In the exemplary embodiment, a majority of a perimeter of the first neck portion 40 about the first axis 42 is received in and overlapped by the second neck portion 140. With reference to FIG. 11, the first and second neck portions 40, 140 overlap between the edges 44 and 146. Based on the perspective of FIG. 11, this range corresponds to "10" to "2" on a clock. The angle of overlap is approximately eighty-seven degrees. It is noted that all numerical values set forth herein are exemplary and not required for all embodiments of the present disclosure. The first and second neck portions 40, 140 also overlap between the edges 46 and 144. Based on the perspective of FIG. 11, this range corresponds to "4" to "7" on a clock. The angle of overlap is approximately one hundred and one degrees. The first and second neck portions 40, 140 do not overlap between the edges 44 and 46 and between edges 144 and 146. Based on the perspective of FIG. 11, these ranges correspond to "7" to "10" and "2" to "4" on a clock. The angles of overlap are approximately ninety-eight and seventy-four degrees, respectively.

In the exemplary embodiment, each of the first neck portion 40 and the second neck portion 140 extend greater than one hundred and eighty degrees about the respective first and second axes 42, 142. The exemplary first neck portion 40 extends two hundred and sixty-two degrees about the axis 42. The exemplary second neck portion 140 extends two hundred and eighty-six degrees about the axis 142.

In the exemplary embodiment, the first plate 26 and second plate 126 overlap one another along portions of the lengths 28, 128. The first neck portion 40 and the second neck portion 140 also overlap one another about the respective first and second axes 42, 142. The overlap of the neck portions 40, 140 occurs partially over the section of overlap of the lengths 28, 128. Thus the top half 24 and the bottom half 22 overlap one another vertically as well as laterally section of overlap of the lengths 28, 128. This section is referenced at 76.

In the exemplary embodiment, the sealing portion 50 of the first neck portion 40 and the sealing portion 150 of the second neck portion 140 confront one another vertically and horizontally when the bottom half 22 and the top half 24 are engaged with one another. This is shown best in FIGS. 17 and 18. The sealing portion 50 defines an outwardly-facing, partially cylindrical surface 78 that confronts an inwardly-facing, partially cylindrical surface 178 defined by the sealing portion 150. When the bottom half 22 and the top half 24 are engaged with one another, the surfaces 78, 178 are pressed into contact with one another and define a seal. The sealing portion 50 also defines an upwardly-facing, ring-shaped surface 80 that confronts a downwardly-facing, ring-shaped surface 180 defined by the sealing portion 150. When the bottom half 22 and the top half 24 are engaged with one another, the surfaces 80, 180 are pressed into contact with one another and define a seal. It is again noted that sealant can be directed into any gaps between the halves 22, 24.

The present disclosure, as demonstrated by the exemplary embodiment described above, can provide an improved roof flashing over the state of the art. A wider range of post sizes can be accommodated, such as posts between one and one-half inches to six inches. Embodiments of the present disclosure can seal around satellite dish antenna arms so the bracket support the dish does not need to be removed when re-shingling the roof. Seals around other pipes (such as up to six inches around) that cannot be sealed with a one-piece flashing. The over-molded sealing portion allows for some sway/motion independent of rigid plates mounted to the roof. Expansion and contraction variations between substrates does not impact on the utility of embodiments of the present disclosure. The relatively rigid pipe portions are not as susceptible to impact, snow, animals or other weight. The rigid plate and pipe portion transitions to a more flexible seal to allow some independent expansion, contraction, seismic, and absorption of forces.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. The right to claim elements and/or sub-combinations that are disclosed herein as other present disclosures in other patent documents is hereby unconditionally reserved.

What is claimed is:

1. A roof flashing comprising:

a bottom half having a first plate extending in a first plane and a first neck portion projecting away from said first plate and said first plane, said first neck portion being arcuate and centered on a first axis that intersects said first plane at an acute angle, said first neck portion defining a first portion of an aperture configured to encircle and seal against a post projecting away from a roof;

a top half having a second plate and a second neck portion projecting away from said second plate, said second neck portion being arcuate and centered on a second axis that intersects said second plate at an acute angle, said second neck portion defining a second portion of said aperture; and at least part of said first neck portion is slidably receivable in said second neck portion, said first neck portion and said second neck portion defining a neck of said roof flashing when said bottom half and said top half are engaged with one another;

wherein said first plate extends a length between an upper edge and lower edge, said upper edge positioned closer to said first portion of said aperture than said lower edge, further wherein at least part of a perimeter of said first neck portion about said first axis is received in and overlapped by said second neck portion, said at least part of said perimeter defined beyond said upper edge and not along said length; and wherein said second plate extends a length between an upper edge and lower edge, said lower edge of said second plate positioned closer to said second portion of said aperture than said upper edge, further wherein second neck portion does not extend past lower edge of said second plate and extends along said length of said second plate.

2. The roof flashing of claim 1 wherein said second plate further comprises:

a first plate portion extending in a second plane, wherein said first and second planes are coplanar when said bottom half and said top half are engaged with one another;

a second plate portion extending in a third plane, wherein said second plane and said third plane are parallel to one another; and a riser portion extending between said first plate portion and said second plate portion, said first plate abutting said riser portion and partially overlapped by said second plate portion when said bottom half and said top half are engaged with one another.

3. The roof flashing of claim 2 wherein said riser portion extends is non-perpendicular relative to said second plane and said third plane.

4. The roof flashing of claim 1 wherein at least one of said first neck portion and said second neck portion further comprises:

a pipe portion formed from a first material;

a sealing portion formed from a second material; and wherein said first material is more rigid than said second material.

5. The roof flashing of claim 4 wherein said sealing portion is formed in situ on said pipe portion.

6. The roof flashing of claim 5 wherein said sealing portion defines a plurality of arcuate, c-shaped portions interconnected by webs.

7. The roof flashing of claim 4 wherein both of said first neck portion and said second neck portion further comprises respective pipe portions and sealing portions.

8. The roof flashing of claim 4 wherein said pipe portion includes a plurality of apertures and said sealing portion is formed in situ on said pipe portion, extending through said plurality of apertures.

9. The roof flashing of claim 1 wherein a majority of a perimeter of said first neck portion about said first axis is received in and overlapped by said second neck portion.

10. The roof flashing of claim 1 wherein at least half of a perimeter of said first neck portion about said first axis is received in and overlapped by said second neck portion.

11. The roof flashing of claim 1 wherein said at least part of said perimeter is further defined by a pair of mirrored, parts of said perimeter.

12. The roof flashing of claim 1 wherein each of said first neck portion and said second neck portion extend greater than one hundred and eighty degrees about said respective first and second axes.

13. The roof flashing of claim 12 wherein each of said first neck portion and said second neck portion extend greater than two hundred and fifty degrees about said respective first and second axes.

14. The roof flashing of claim 1 wherein said roof flashing extends a length between said upper edge of said top half and said lower edge of said bottom half and said first plate and second plate overlap one another along a portion of said length of said roof flashing and said first neck portion and said second neck portion also overlap one another along said respective first and second axes across said portion of said length of said roof flashing whereby said top half and said bottom half vertically and laterally overlap along said portion of said length of said roof flashing.

15. The roof flashing of claim 1 wherein each of said first neck portion and said second neck portion further comprises:

a pipe portion formed from a first material;

a sealing portion formed from a second material;

wherein said first material is more rigid than said second material; and wherein said sealing portion of said first neck portion and said sealing portion of said second neck portion confront one another vertically and horizontally when said bottom half and said top half are engaged with one another.

* * * * *